United States Patent [19]

Barré

[11] 4,108,325

[45] Aug. 22, 1978

[54] DEVICE FOR WATERTIGHT STOPPERING OF BOTTLES

[76] Inventor: René Emile Léon Barré, 39, boulevard Bourdon, Paris, France, 75004

[21] Appl. No.: 838,461

[22] Filed: Oct. 3, 1977

[30] Foreign Application Priority Data

Oct. 5, 1976 [FR] France ..... 76 29935

[51] Int. Cl.[2] ..... B65D 39/18

[52] U.S. Cl. ..... 215/364

[58] Field of Search ..... 215/355, 364; 217/110

[56] References Cited

U.S. PATENT DOCUMENTS

| | | | |
|---|---|---|---|
| 1,989,218 | 1/1935 | Villanyi | 215/364 |
| 3,172,555 | 3/1965 | Honnorat | 215/364 |
| 3,599,820 | 8/1971 | Lee | 215/364 |

FOREIGN PATENT DOCUMENTS

| | | | |
|---|---|---|---|
| 1,479,255 | 3/1967 | France | 215/364 |
| 973,425 | 9/1950 | France | 215/364 |

*Primary Examiner*—Donald F. Norton

[57] ABSTRACT

A watertight device for stoppering a bottle, in which a ring, made of flexible matter, is located in a groove or grooves of the stopper stem, the groove or grooves being formed partly with a notched surface, and partly with a smooth and circular external surface. The ring has corresponding mating, notched and smooth surfaces.

5 Claims, 4 Drawing Figures

DEVICE FOR WATERTIGHT STOPPERING OF BOTTLES

BACKGROUND OF THE INVENTION

The present invention relates to a device for watertight stoppering of bottles, through interchangeable glass stoppers, any bottle of one same series being able to be stopped by any stopper of the corresponding series.

At present, glass-to-glass interchangeable stoppering is obtained by roughening the outer surface of the stopper stem, and of the internal side of the bottle neck. The operations of grinding will produce a more or less rough surface, on the bottle neck as on the stopper stem. The glass-to-glass stoppering of the stopper stem on the bottle neck requires the addition of a lubricating grease on the bottle neck, in order to prevent both surfaces to seize each other, and to improve watertightness, such as is currently used in vacuum chambers.

For supplying a substitute for this application of lubricating grease, in order to obtain the above performances, it is possible to add into one or more grooves made into the stopper stem a flexible product which remains integral with this stopper. The resulting ring made of flexible matter has a tendency to rotate about the stopper stem in the groove (or grooves) of the stopper, according to the nature of the flexible product being used, when the stem and the bottle neck come in contact, the flexible product slipping into the bottom of said grooves.

For overcoming this disadvantage, during the moulding process of the bottle, the bottom of the groove, or grooves, of the stem is provided with notched teeth.

The depth variations resulting from the successive teeth and hollows determine difference of contraction of the flexible matter this contraction being dependent on the depth of the flexible matter itself. For this reason, when installed in a bottle neck, the external surface of the flexible ring consists of a successive series of facets, which are more or less rounded. The ring makes spaced-apart points of contact with the bottle neck instead of being perfectly circular concentrically to the stem. The engagement of these spaced facets on the bottle neck is a possible cause for lack of watertightness of the bottle, resulting in leakage of the liquid inside.

SUMMARY OF THE INVENTION

The object of the invention is to provide a watertight device for stoppering a bottle, in which a ring made of flexible matter is located in the groove or grooves of the stopper stem, the groove or grooves having partially a notched surface and the ring having a perfectly smooth and circular external surface.

The present invention provides a watertight device for stoppering a bottle, characterized by the fact that the groove or grooves of the stopper stem have respectively one or several areas having a notched surface and one or several areas having a smooth surface, so that the ring made of flexible matter, clamped on one part of its internal surface by the teeth formed into said grooves, has a perfectly smooth and circular external surface.

According to a particular embodiment of the invention, the internal part of the groove, or grooves, of the stopper stem can have a circular area being notched at the upper part of said grooves, while the smooth circular area is located at the lower part, with the stoppering device being viewed vertically.

According to another mode of implementation, the internal part of the groove or grooves of the stopper stem can have a circular area being notched at the lower part of the grooves, while the smooth circular area is located at the upper part, the stoppering device being viewed vertically.

According to another mode of implementation, the notched circular area of the bottom of the groove or grooves of the stopper stem can be substantially located in the middle of the grooves, circular areas being located from each side of the notched circular area.

According to another mode of implementation, the internal part of the groove or grooves of the stopper stem can be fitted with two notched circular areas separated by a smooth circular area.

BRIEF DESCRIPTION OF THE DRAWINGS

This invention will now be described by way of non limiting examples, with reference to the accompanying drawings in which FIG. I is a partial vertical cross-section view illustrating the stopper according to the invention, being inserted into the neck of a bottle.

DETAILED DESCRIPTION OF THE PREFERRED EMBODIMENT

According to these figures, the stopper I has a stem 2, which is in the shape of a truncated cone, and wherein there has been made a circular groove, the bottom of which features respectively a smooth circular area 3 and a notched circular area 3'. A flexible ring 4 has been inserted into this groove.

Figure 1:
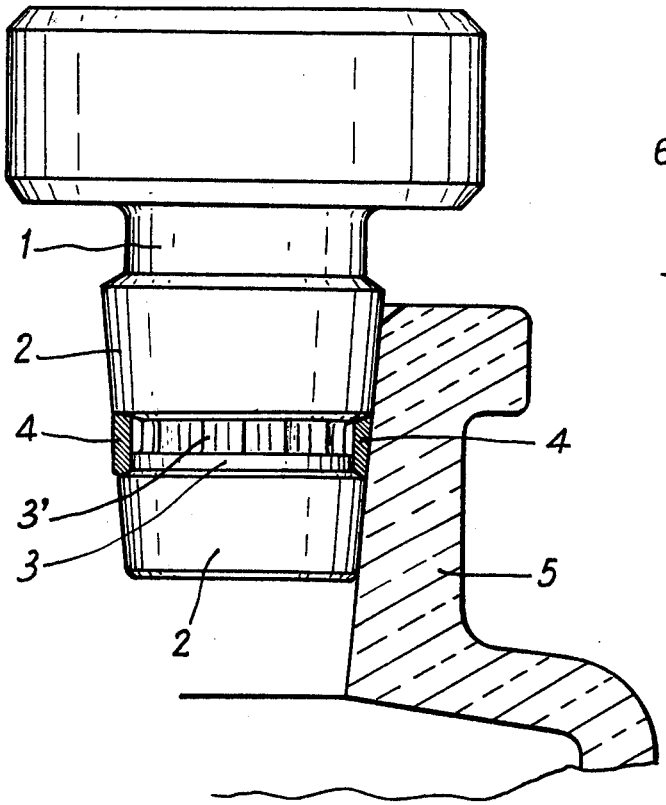
Figure 2:
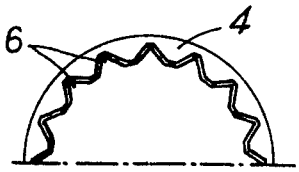
FIG. 2 is a partial horizontal cross-section view of a groove of a stopper stem illustrating a notched area onto which is fitted a flexible ring.

The FIG. 2 shows, in cross-section, through a notched area 3' of the groove, the teeth 6 of this latter. The ring 4 can be made by moulding together with the groove of the stem or independently from this groove and inserted into it afterwards.

Once the stem 2 of the stopper I has been inserted into the neck 5 of the bottle, the flexible ring 4 is crushed against the internal part of the neck. The ring 4 fitting into hollows between teeth 6 is fixed into position, thus preventing its rotation. Thanks to the smooth area 3 on which is partially supported the ring 4, this ring retracts in a uniform manner, which avoids formation of facets on the external side and allows to obtain a smooth external surface.

In this way, a perfect adherence of the ring 4 against the internal surface of the neck 5 of the bottle is ensured.

Figure 3:
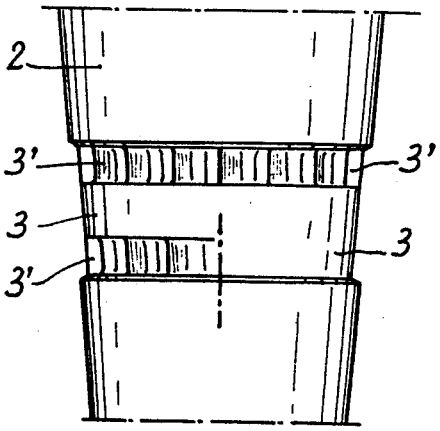
FIGS. 3 and 4 illustrate three various implementations of partially notched grooves according to the invention.

The FIG. 3 illustrates a groove of a stopper stem 2 which has in the left part, two notched areas 3' located from each side of a smooth part 3 and, in the right part, a notched area 3' located above a smooth area 3.

Figure 4:
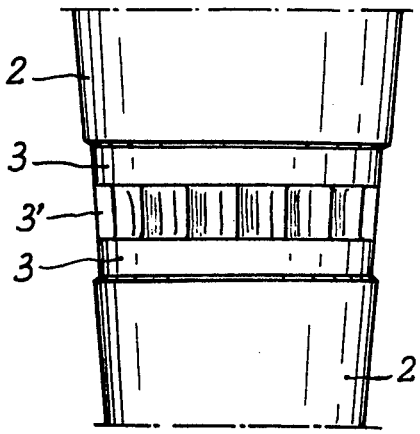

FIG. 4 illustrates a groove of a stopper stem 2 having in the middle a notched area 3' between two smooth areas 3 from each side.

The smooth area, or areas, of the groove or grooves of the stem will have advantageously a depth identical with the one of the tops of teeth of the notched area or areas, so that the flexible ring 4 will have a sufficient but non excessive depth. The purpose of this arrangement is to decrease the contraction effect of the flexible matter after its moulding into the groove or grooves of the stopper stem.

It will be apparent that this arrangement could be modified in details by using equivalent technical means without thereby departing from the scope of the claims.

What I claim is:

1. A device for watertight stoppering of bottles, comprising:

a stopper stem having at least one circumferential groove with a toothed annular surface portion and an adjacent smooth annular surface portion;

and a ring made of flexible matter, clamped on a portion of its internal surface by the teeth formed into said grooves, said ring having a portion thereof radially adjacent said smooth annular surface portion to maintain a perfectly smooth and circular external surface on said ring when said device is installed in a bottle, said stem further including at least one tapered annular surface adjacent said groove for contacting the interior surface of the bottle.

2. A device for watertight stoppering of bottles according to claim 1, wherein the toothed annular surface portion is located at the upper part of said groove, while the smooth annular surface portion is located at the lower part of said groove, the stoppering device being viewed vertically.

3. A device for watertight stoppering of bottles, according to claim 1, wherein the toothed annular surface portion is located at the lower part of said groove, while the smooth annular surface portion is located at the upper part of said groove, the stoppering device being viewed vertically.

4. A device for watertight stoppering of bottles, according to Claim 1, wherein the toothed annular surface portion of the groove of the stopper stem is located substantially in the middle of said groove, with smooth annular surface portions being located on each side of the toothed annular surface portion.

5. A device for watertight stoppering of bottles according to claim 1, wherein said groove has two toothed annular surface portions separated by a smooth annular surface portion.

* * * * *